United States Patent [19]

Bechtel

[11] Patent Number: 4,531,321

[45] Date of Patent: Jul. 30, 1985

[54] SCOPE-MOUNTING DEVICES FOR FIREARMS

[76] Inventor: Daniel L. Bechtel, P.O. Box 11281, Ft. Worth, Tex. 76109

[21] Appl. No.: 457,492

[22] Filed: Jan. 12, 1983

[51] Int. Cl.[3] ..... F41G 1/38

[52] U.S. Cl. ..... 42/1 ST; 33/248

[58] Field of Search ..... 42/1 ST; 33/245, 247, 33/248, 250

[56] References Cited

U.S. PATENT DOCUMENTS

| | | | |
|---|---|---|---|
| D. 269,449 | 6/1983 | Bechtel | D22/7 |
| D. 269,450 | 6/1983 | Bechtel | D22/7 |
| D. 270,173 | 8/1983 | Bechtel | D22/7 |
| 2,018,960 | 10/1935 | Kuhn | 33/248 |
| 2,018,961 | 10/1935 | Kuhn | 33/248 |
| 2,775,817 | 1/1957 | Schuman | 33/247 |
| 4,317,304 | 3/1982 | Bass | 42/1 ST |
| 4,383,371 | 5/1983 | Coffey | 42/1 ST |

*Primary Examiner*—Charles T. Jordan

*Attorney, Agent, or Firm*—Charles W. McHugh

[57] ABSTRACT

An apparatus adapted for mounting an auxiliary sighting device (such as a scope or night-vision device) on a firearm includes an anchor member which has a surface that is configured so as to abut a portion of the firearm's exterior surface in load-bearing contact. The anchor member has a longitudinal portion through which a pair of spaced bores extend in a transverse direction. A beam having a length greater than the length of the anchor member has a pair of transverse bores whose centers coincide at least approximately with the centers of the two bores on the anchor member. The diameter of a first one of the beam bores is essentially the same as the diameter of one of the anchor member bores, but the diameter of the second beam bore is significantly different in comparison with the diameter of its associated anchor member bore. A bearing member is sized for a snug fit within those two bores of the anchor member and the beam that are essentially the same size; and the bearing member is adapted to function as a pivot for the beam in order to foster alignment of the beam with respect to the barrel. Set screws or the like are utilized to securely hold the beam in a selected alignment position. Mounting rings or the like are adapted for connecting an auxiliary sighting device to the beam, so that the line of sight of the sighting device may be adjusted with respect to the axis of the firearm barrel by pivoting the beam.

3 Claims, 11 Drawing Figures

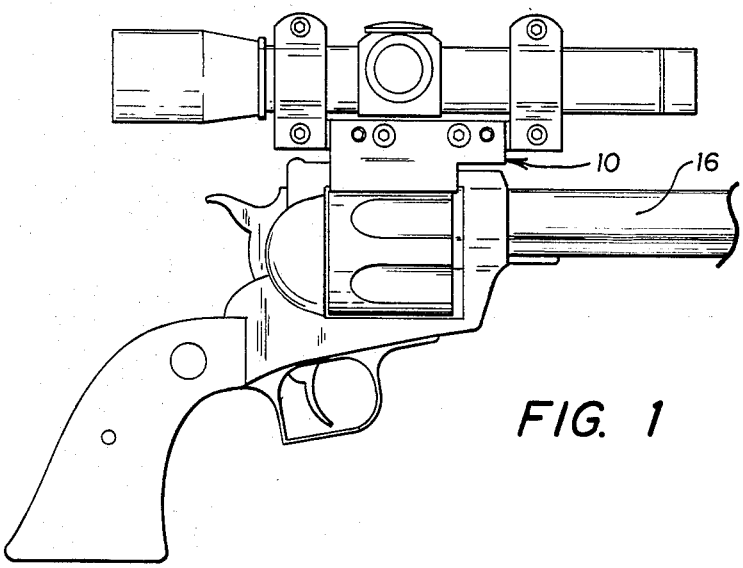
FIG. 1
FIG. 2
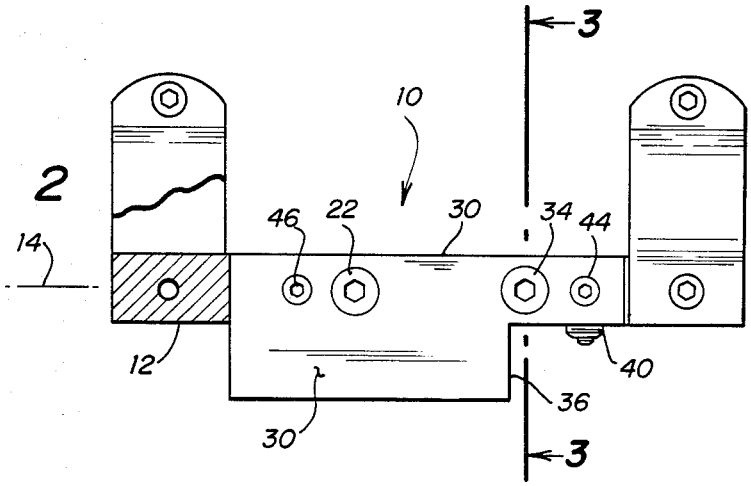
FIG. 3
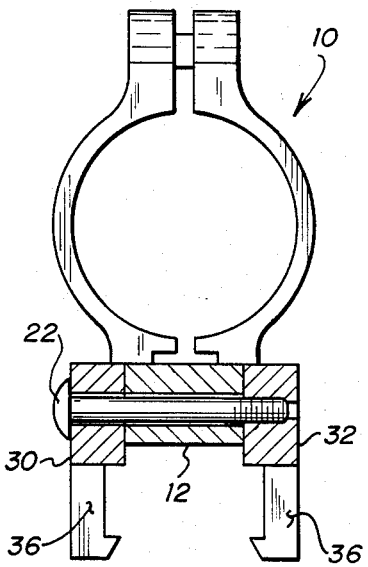
FIG. 4
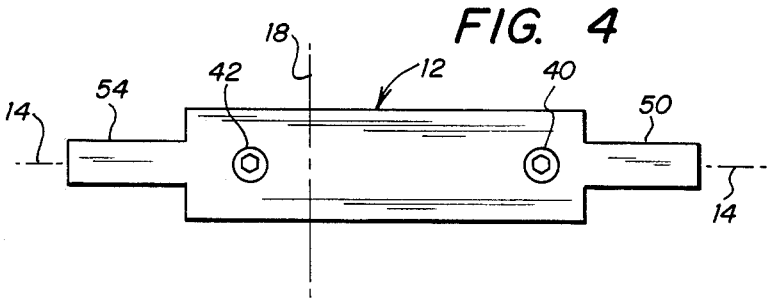
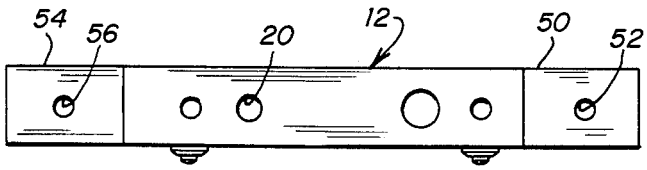
FIG. 5

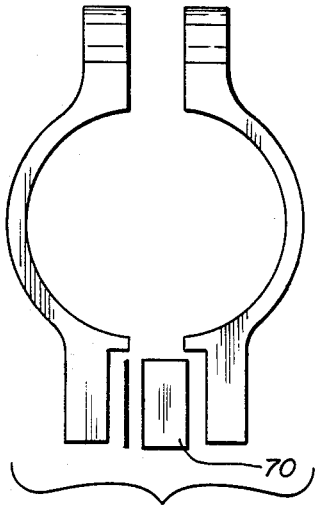
FIG. 11
FIG. 9
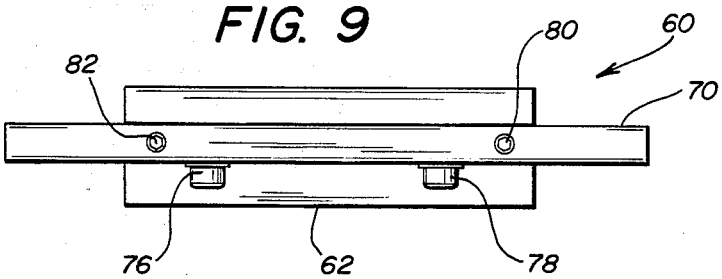
FIG. 7
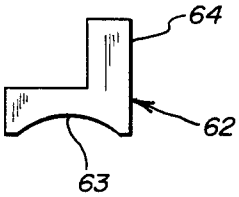
FIG. 6
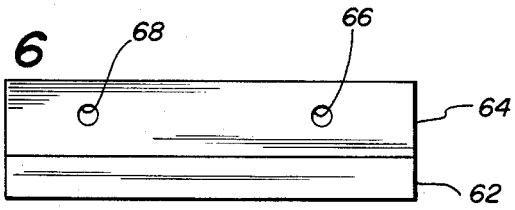
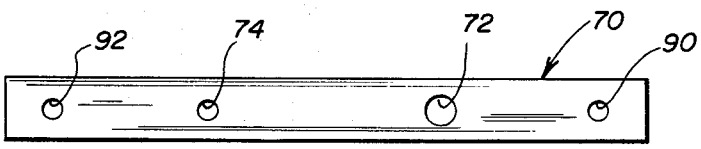
FIG. 8
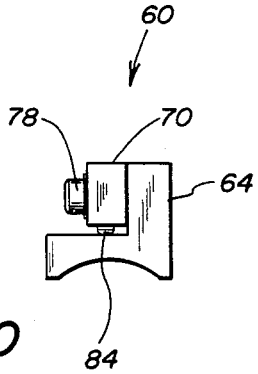
FIG. 10

SCOPE-MOUNTING DEVICES FOR FIREARMS

BACKGROUND AND OBJECTS OF THE INVENTION

This invention relates generally to scope mounts which are adapted to mount a scope onto a firearm; more specifically, it relates to a construction which is capable of being utilized on a wide variety of pistols, rifles and shotguns, and which does not require the special skills and tools normally possessed by a gunsmith.

It is well known to improve the accuracy that can be obtained in shooting a pistol or rifle by affixing a scope in such a way that the longitudinal axis of the scope is at least approximately parallel to the longitudinal axis of the firearm's barrel. Many rifles, for example, have scope mounting holes that are bored into the receiver of the rifle at the factory; such holes are then threaded in order to receive the screws/bolts that constitute the mounting device for the scope mount. However, not all guns have such pre-drilled and tapped holes. And, there are also occasions when the owner of a particular gun would prefer to avoid use of factory-drilled holes, especially if the use of those holes would necessarily dictate that something else (such as open sights that are provided as standard equipment on the rifle) has to be removed. Hence, there has long remained a need for a reliable way of mounting a scope on a rifle or other firearm—perhaps long after the rifle has left the factory, and maybe even after it has been used for hunting, target shooting and the like.

If a person is a skilled gunsmith, the addition of a scope mount to a rifle or pistol may offer only a minimal challenge, provided that everything goes right, and provided further that the heat treat of the steel in the firearm has not made it too hard to drill, and the tap that is being used to create threads in a bored hole does not break, etc. But without proper equipment and without the skill that comes from careful instruction and training, it is possible for a novice to completely ruin a firearm as a result of an imprudent move or the application of a careless force. For this reason, among others, it is desirable to build scope mounts that do not require the meticulous drilling and tapping of holes that are typical of the prior art. Such mounts are often advertised as "no gunsmithing" mounts, regardless of whether they are utilized by a gunsmith or an untrained person. It is a normal characteristic of such scope mounts that they are easy and fast to instal—by both trained and untrained personnel. If for no other reason than speed and economy, such no-gunsmithing mounts can be highly desirable.

One factor that has perhaps limited the widespread use of no-gunsmithing mounts is the manufacturing tolerances that are characteristic of firearms, e.g., plus or minus 0.010 inch for many dimensions. If a manufacturer of scope mounts attempted to accommodate such tolerances with designs of the prior art, there is a great chance that there would be too many cases of loose fits on some guns and interference fits on others. So, even though it has been known for quite some time that no-gunsmithing mounts would offer substantial economies, they have still not been designed and produced in the quantities that would appear to be expected. Accordingly, it is an object of this invention to provide a construction which is particularly adapted for mounting auxiliary sighting devices (including scopes and night-vision devices) on firearms without the need for specialized tools and skills of a gunsmith.

Another object is to provide a scope mount construction which has a great latitude of movement between relatively moing parts, in order that a great range of adjustments might be made within the mount itself.

Still another object is to foster repeatability in the alignment that is achieved between a sighting device (hereinafter often referred to for convenience as simply a scope) and a firearm—when the scope is repeatedly installed on and removed from the firearm.

These and other objects will be apparent from a reading of the specification and the claims appended thereto, as well as reference to the attached drawings in which FIG. 1 is a side elevational view of a pistol on which a scope has been mounted using an apparatus in accordance with the invention;

FIG. 2 is a partially sectioned, side elevational view—similar to FIG. 1, showing the apparatus on a different scale (for better visibility of certain parts);

FIG. 3 is a cross-sectional view taken in the plane represented by line 3—3 of FIG. 2;

FIG. 4 is a top plan view of the rocking base upon which scope-mounting rings or the like are typically attached;

FIG. 5 is a side elevational view of the rocking base;

FIG. 6 is a side elevational view of an anchor member which is adapted to bear against an exterior surface of a firearm, typically the top thereof;

FIG. 7 is a front end view of the anchor member shown in FIG. 6;

FIG. 8 is a side elevational view of a beam which is configured to match the anchor member shown in FIGS. 6 and 7;

FIG. 9 is a top plan view showing the assembly of the elements shown in FIGS. 6, 7 and 8;

FIG. 10 is a front end view of the embodiment shown in FIG. 9; and

FIG. 11 is an exploded view of the combination of a scope-mounting ring, a "rocking" beam, and optional shims which are useful in effecting a spatial adjustment of a scope with respect to a fiream barrel.

BRIEF DESCRIPTION OF THE INVENTION

In brief, the invention includes a base which is adapted to be mounted on a firearm so that the longitudinal axis of the base is generally parallel to the longitudinal axis of the barrel. The base also has a pivotable axis which is perpendicular to its longitudinal axis. A structural means is provided for rigidly connecting the base to the frame of the firearm when the base has a desired inclination with respect to the barrel. A bearing has a longitudinal axis coincident with the pivotable axis of the base, in order to foster adjustment of the base in a longitudinal plane that encompasses the barrel of a firearm. At least one adjustment screw is also provided—preferably at a location somewhat removed from the bearing, in order to foster adjustment of the inclination of the base with respect to the barrel. Preferably, there are two adjustment screws, one of which is in front of the pivotable axis and the other being behind the pivotable axis. Additionally, there is provided some structure for rigidly connecting the base to the frame of the firearm when the base has a desired inclination with respect to the barrel. In one embodiment, such a structural arrangement comprises two side plates which are brought together in a clamping fashion by one or more threaded members. Finally, scope rings or the like are provided for connecting a scope to the base.

DETAILED DESCRIPTION OF THE PREFERRED EMBODIMENTS OF THE INVENTION

Referring initially to FIGS. 1 and 2, an apparatus 10 is shown that is adapted for mounting a scope on a pistol. The apparatus includes a base 12 having a longitudinal axis 14 that is adapted to be oriented parallel to the longitudinal axis of the pistol's barrel 16. The base also has a pivotable axis 18 that is perpendicular to its longitudinal axis. Therefore, when the base is properly mounted on the firearm, the pivotable axis 18 will be generally perpendicular to the longitudinal axis of the barrel 16. A bore 20 in the base 12 is concentric with the pivotable axis 18, and the bore has a diameter which is appropriately sized to snugly receive a bearing 22, so that the base may be pivoted in order to foster adjustment of the inclination of the base with respect to the barrel. While the bearing 22 (and its associated bore 20) permits adjustment of the relative inclination of the base, there must still be provided something to physically ensure that such an adjustment—once it has been accomplished—will be maintained. In this regard, it must be recalled that the recoil of a pistol is often substantial; and any attempt to mount a scope on a pistol must take into account the significant forces that will arise every time that the pistol is discharged.

Accordingly, there must be some structural means for rigidly connecting the base 12 to the frame of the pistol after the base has been oriented so that it has a desired inclination with respect to the barrel 16. A preferred structural means for providing the rigid connection between the base 12 and the frame comprises a pair of side plates 30, 32 which are placed on opposite sides of some portion of the firearm frame and held tightly together by at least one bolt 34 which passes through the pair of plates in order that they may be pulled together. When tension is established in bolts 34, that portion of the firearm frame which is captured between the two plates 30, 32 must, of course, be sufficiently rigid as to provide a reliable "anchor" for the side plates. The strap that extends over the cylinder of a revolver is such a rigid "anchor" for the side plates 30, 32 and the base 12. A further property of the selected anchor portion of the firearm is that its width must be at least slightly greater than the width of the base 12, in order that the two side plates will not bear against the base prior to the time that a tight gripping force has been achieved between the side plates and the firearm frame. That is, there should ideally be at least a small amount of side clearance between the base 12 and the side plates 30, 32 at the time that the distal portions of the side plates have engaged and begun to apply a compressive load on that portion of the firearm frame which has been selected as the "anchor" portion.

Another characteristic of the pair of side plates 30, 32 is that they must have sufficient stiffness and/or rigidly as to be capable of applying a significant compressive force between their two cantilevered (lower) edges, so that there will be no discernible flexing when the one or more connecting bolts are tightened in the upper part of the side plates. A suitable material for this purpose is extruded and/or machined aluminum which has been hardened to T6 and has a minimum thickness of about 3/16 inch. Another suitable material is a steel investment casting—as cast or heat treated. In the embodiment shown in FIG. 2, the side plates 30, 32 have a thickness in the upper portion of about 0.10 inch, which offers a substantial quantity of material for providing a threaded bore into which a bolt (e.g., bolt 34) can be threaded. Providing a threaded bore is preferable to simply drilling a smooth hole and relying on an external nut to engage the connecting bolt—in order to rigidly mount the apparatus 10 to the frame of the firearm. However, it should be appreciated that any technique for pulling the two side plates together so that they tightly capture a portion of the frame therebetween should be considered to be a feasible way of accomplishing the desired rigid connection.

In order to economize on the number of parts that are employed with this construction, it is particularly advantageous to accomplish two tasks with the aforementioned bearing 22 about which the base pivots in a vertical plane. This is achieved by providing external threads on the bearing 22, so that it functions both as a pivot point for the base 12 and as a clamping screw to grip the pistol frame tightly between the two side plates 30, 32. Furthermore, in order to promote economy and standardization in the manufacture of the apparatus 10, it is preferred that the bearing 22 and the bolt 34 be identical in both diameter and length; a typical size for these elements is a $10\text{-}32\times\frac{7}{8}$ cap screw. Of course, in order to achieve the relative movement that is necessary in order to allign the scope in a desired manner, the diameter of bore 20 that receives bearing 22 must be substantially less than the diameter of the rear hole through which bolt 34 passes. Expressed another way, there is substantial clearance around bolt 34, so that the base 12 may have an appreciable degree of freedom to pivot about bearing 22. In general, moving the front of base 12 up or down by perhaps 0.020 inch with respect to a center position will be all of the adjustment that would reasonably be required in order to align a scope in a desired manner with the barrel of the firearm. So, a hole diameter 0.040 inch greater than the diameter of bolt 34 should be adequate for most needs.

While a certain amount of inclination adjustment of the base is possible by exercising personal judgment as to when to achieve maximum gripping power with bolts 22, 34, such an adjustment could be criticized as being relatively crude. Accordingly, a preferred embodiment of the invention includes a more positive means for adjusting the inclination of the base 12 with respect to the barrel 16. This positive means includes at least one vertical adjustment member which extends downwardly through the base 12 where it is permitted to make contact with and bear against some portion of the firearm. In the preferred embodiment, this positive adjustment means includes a first adjustment member 40 in front of the pivotal axis 18 and a second adjustment member 42 behind the pivotal axis 18. The preferred form for each of these adjustment members 40, 42 is a tapped hole extending all the way through the base 12—which is engaged by a set screw; and, if desired, the set screw may have a brass tip in order to avoid the risk of creating an unsightly blemish on the surface of the firearm. By alternately raising one of the two set screws 40, 42 and lowering the other, the inclination of the base 12 can be firmly and tightly regulated. And, after the desired inclination has been achieved, another way in which it can be maintained is to provide transverse openings through one side of the base. These transverse openings are threaded in order to accommodate relatively small locking screws 44, 46 which bear against the set screws 40, 42 and help prevent them from becoming loosened as a result of recoil forces that may be exerted thereon.

In the optimum form of the invention, the base 12 has a length of about 4 inches, which readily permits the two set screws 40, 42 to be separated by at least 1 inch and preferably 1½ inches. (This facilitates the inclination of the base with respect to the longitudinal axis of the firearm through an angle that is sufficient to move the line of sight at least 20 inches at 100 yards.) At respective ends of the base are front and rear elements 50, 54 which are configured to receive rings for connecting a scope or other auxiliary sighting device to the base. The preferred technique for this connection constitutes a transverse aperture 52 that is bored horizontally through element 50, and a similar aperture 56 bored through element 54. These apertures 52, 56 are sized to receive bolts that securely clamp scope rings to the base at two widely separated points.

Another feature of the side plates shown in FIG. 1 is the provision of a generally vertical and forwardly facing bearing surface 36 on each of the side plates 30, 32, which surface is provided to bear against the front of the opening for the revolver's cylinder. By providing this solid surface 36 which makes intimate contact with a rigid portion of the revolver, a substantial part of the recoil that typically occurs when the pistol is discharged is passed to the mount directly through metal-to-metal contact. That is, recoil loads having a longitudinal component do not have to be passed to the side plates through any bolt, screw or other fastener; and, those longitudinal recoil loads which are subsequently passed from the side plates to the base are passed through two fasteners—which helps distribute said loads in such a way as to minimize any tendency to loosen the fastners.

Another embodiment of the invention is appropriate for certain firearms (pistols, rifles and shotguns) which do not have a configuration that is susceptible to a pinching or clamping action in order to provide a foundation upon which a pivotable base can be secured. Referring to FIGS. 6–10, the apparatus 60 includes an anchor member 62 which has one exterior surface 63 that is configured to bear against an exposed surface of the firearm in order to provide adequate load-bearing contact between the anchor member and the firearm. The anchor member 62 also has an upper portion which will be referred to (for convenience) as an elongated member or rail 64. The rail 64 has a longitudinal axis which is intended to be placed so it is approximately parallel to the longitudinal axis of the firearm's barrel; and, for simplicity in manufacturing, the rail will normally be continuous. However, if the operation of the firearm should cause an empty shell to be ejected in a direction that would cause it to strike a mid-portion of the rail 64, it is possible to provide a gap within part of the rail so as not to interfere with normal shell ejection.

Provided within the rail 64 are two transversely oriented bores 66, 68, with the front bore 66 being spaced as far from the rear bore 68 as is feasible—but at least one inch. (If the spacing between the front and rear bores 66, 68 is significantly less than one inch, there will usually not be sufficient distance to create the desired elevation adjustment when an auxiliary sighting device is subsequently affixed to the base.) Whenever possible, it is preferred that the spacing between the two bores 66, 68 permit at least a 20″ (and preferably 30″) adjustment in the strike of a bullet at 100 yards.

A beam 70 having a length greater than the length of the rail 64 also has a pair of transverse bores 72, 74. The centers of the bores 72, 74 coincide at least approximately with the centers of the two rail bores 66, 68. The diameter of the rear bore hole 74 is essentially the same as the diameter of the rail bore hole 68, but the diameter of the forward beam bore 72 is significantly different in comparison with the diameter of the rail bore 66. The reason for this difference in bore diameters is to permit the beam to be selectively rocked or pivoted with respect to the rail, and hence pivoted with respect to the longitudinal axis of the firearm's barrel; the pivoting referred to here is in a plane that includes the longitudinal axis of said barrel. Pivoting is accomplished by providing a bearing member 76 which is sized for a snug fith within bores 68, 74. That is, when the foremost portion of the beam 70 is raised or lowered with respect to rail 64, then forward bores 66, 72 may be considered to experience relative sideward movement. By use of the term "snug fit", it is intended to refer to the closest fit that can be assembled by hand without appreciable pressure. There is essentially zero allowance, and the parts doe not shake or move freely under a load.

After the beam 70 has been pivoted about bearing member 76 so as to achieve a desired alignment of the beam, there is obviously a need for rigidly maintaining the desired relative position—even though the firearm may be subjected to substantial recoil loads when it is fired. At least one way for rigidly holding the beam in fixed position next to the rail comprises a high-strength screw 78 which extends transversely through bores 66, 72. Ideally, the bore 66 is threaded so as to receive male threads on screw 78; a typical screw for this purpose is a 10–32×¾ socket head screw. A further means for rigidly holding the beam 70 in a desired alignment includes two "vertical" bores on the beam, which bores are positioned at opposite ends of the beam so that they lie on different sides of the pivot bore 74. When bearing member 76 has been threadably engaged with bore 68, the beam 70 is free to pivot about the axis of bearing member 76 (like a see-saw or "teeter-totter") until such time as set screws are threaded into the bores 80, 82 until they bear against a surface of anchor member 62. The frontal set screw in vertical bore 80 is particularly beneficial in minimizing the holding task that would otherwise rest on screw 78, because the rear of a scope normally tends to be forced upwardly when a firearm is fired; firing also tends to rotate the front of the rail downwardly when such rotation is physically possible. By taking at least some of the recoil loading with forward set screw 84 in "vertical" bore 80, the tension loading on "horizontal" screw 78 need not be so great.

As with the earlier described embodiment, there are provided smooth bores 90,92 at respective ends of the beam 70—in order to accommodate bolts that can readily secure scope-mount rings to the beam. By using vertically split scope-mount rings, the sighting device may be adjusted both vertically and horizontally with respect to the longitudinal axis of the firearm's barrel. The "horizontal" adjustment is accomplished by placing small shims, as required, on either the right or left sides of the vertically oriented end surfaces of the beam 70, as shown in FIG. 11. In other words, putting one or more shims on the side of the beam prior to installing a vertical scope-mount ring can physically shift one ring with respect to the other ring; of course, this shift takes place in a plane that is perpendicular to the longitudinal axis of the firearm's barrel.

After the beam 70 has been appropriately aligned with respect to the barrel, and after the respective fasteners have been tightened so as to rigidly hold the achieved alignment, the scope rings or other supporting hardware for a sighting device can be selectively removed and replaced without affecting the position of a beam and its supporting structure. That is, after the beam 70 has been correctly oriented for a specific rifle, a sighting device may be sequentially installed and removed without risking any significant change in the relative orientation between the scope and the firearm. And, if desired, a variety of different sighting devices may be alternately employed with a variety of rings that are sized so as to match the thickness and depth of a single rail.

In addition to the two principal embodiments illustrated herein, it should be apparent to those skilled in the art that other variations in size, shape and proportion would be capable of being incorporated into the system described herein. Accordingly, the invention should be understood to include all of the modifications and variations that are suggested herein and contemplated by the claims appended hereto.

I claim:

1. An apparatus adapted for mounting an auxiliary sighting device such as a scope on a firearm, and the firearm having a longitudinal barrel and a frame, comprising:

(a) a base having a pivotal axis, and the base being adapted to be mounted on the firearm so that the pivotal axis is generally perpendicular to the longitudinal axis of the barrel, and said base also having a longitudinal axis that is adapted to be oriented so that it is approximately parallel to the longitudinal axis of the barrel;

(b) bearing means for pivoting the base about its pivotal axis in order to foster adjustment in a vertical plane of the relative inclination of the base with respect to the barrel;

(c) means for adjusting the inclination of the base with respect to the barrel, and said means including a first vertical adjustment member in front of the pivotal axis and a second vertical adjustment member behind the pivotal axis;

(d) structural means for rigidly connecting the base to the frame of the firearm when the base has a desired inclination with respect to the barrel, and said structural means including a pair of plates which are placed on opposite sides of a portion of the firearm frame, and further including at least one bolt which passes through the pair of plates in such a way as to permit pulling the plates together in order to rigidly capture a portion of the firearm frame between the plates, and wherein said at least one bolt also passes through an opening in the base, and the size of said base opening being appreciably larger than the diameter of the bolt, whereby the presence of the bolt does not interfere with the action of rotating the base about its pivotal axis during the adjustment thereof; and (e) means for connecting an auxiliary sighting device to the base.

2. An apparatus adapted for mounting an auxiliary sighting device such as a scope on a firearm, and the firearm having a longitudinal barrel and a frame, comprising:

(a) a base having a pivotal axis, and the base being adapted to be mounted on the firearm so that the pivotal axis is generally perpendicular to the longitudinal axis of the barrel, and said base also having a longitudinal axis that is adapted to be oriented so that it is approximately parallel to the longitudinal axis of the barrel;

(b) bearing means for pivoting the base about its pivotal axis in order to foster adjustment in a vertical plane of the relative inclination of the base with respect to the barrel;

(c) means for adjusting the inclination of the base with respect to the barrel, and said means including a first vertical adjustment member in front of the pivotal axis and a second vertical adjustment member behind the pivotal axis;

(d) structural means for rigidly connecting the base to the frame of the firearm when the base has a desired inclination with respect to the barrel; and (e) means for connecting an auxiliary sighting device to the base, including two structural extensions that are integrally formed with said base and which respectively extend forwardly and rearwardly of said base, and each of said extensions having a transverse aperture for receiving a bolt which is adapted to secure a mounting ring to the extension, and each mounting ring being centrally split into two halves by a plane that passes longitudinally through the firearm's barrel, whereby the relative inclination of the auxiliary sighting device may be adjusted with respect to the base by placing appropriate shims alongside the base and interiorly of the split mounting rings.

3. An apparatus adapted for mounting an auxiliary sighting device on a firearm, and the firearm having a barrel with a longitudinal axis, comprising:

(a) an anchor member having a surface which is configured so as to abut a portion of the exterior surface of the firearm in load-bearing contact, and said anchor member having a longitudinal rail which extends in a direction approximately parallel to the firearm barrel, and said rail having a pair of spaced bores which extend transversely through the rail near opposite ends thereof;

(b) a beam having a length greater than the length of said rail and having a pair of transverse bores whose centers coincide at least approximately with the centers of the two bores on said rail, and the diameter of a first one of the beam bores being essentially the same as the diameter of one of the rail bores, and the diameter of the second beam bore being significantly different in comparison with the diameter of the second rail bore;

(c) a bearing member which is sized for a snug fit within those two bores of the rail and the beam that are essentially the same size, and the bearing member being adapted to function as a pivot for the beam in order to foster sideward movement of one of the non-equal bores with respect to its confronting bore, and wherein the two confronting bores of the rail and the beam which are essentially the same size are positioned to the rear of the two non-equal bores when the apparatus is mounted on the firearm, such that pivotable adjustment of the beam with respect to the rail is accomplished by pivoting the beam about a rearward pivot axis that extends through the two essentially equally sized bores, and wherein the two bores on the rail have essentially equal sizes, and the two bores on the beam have significantly non-equal sizes, and wherein the confronting surfaces of the beam and the rail are both smooth and flat, such that any necessary shims may be selectively placed between the beam and the rail for physically shifting the sighting device in a plane that is perpendicular to the longitudinal axis of the firearm's barrel;

(d) means adapted for connecting an auxiliary sighting device to the beam, whereby the line of sight of an auxiliary sighting device may be adjusted with respect to the axis of the firearm barrel by pivoting the beam with respect to the rail; and (e) means for rigidly securing the beam to the rail after a desired relative orientation has been established between the beam and the rail.

* * * * *